United States Patent [19]

Mehrkam

[11] 4,109,897

[45] Aug. 29, 1978

[54] SALT RECLAMATION SYSTEM

[75] Inventor: Quentin D. Mehrkam, Bryn Mawr, Pa.

[73] Assignee: Ajax Electric Company, Huntingdon Valley, Pa.

[21] Appl. No.: 673,462

[22] Filed: Apr. 5, 1976

[51] Int. Cl.[2] ..... C21D 1/46

[52] U.S. Cl. ..... 266/120

[58] Field of Search ..... 266/120, 107; 148/15, 148/20; 134/13, 109, 135; 423/DIG. 12

[56] References Cited

U.S. PATENT DOCUMENTS

| | | | |
|---|---|---|---|
| 1,989,884 | 2/1935 | Reinhardt | 148/15 |
| 2,014,295 | 9/1935 | Rosenberg | 266/120 X |
| 2,516,516 | 9/1950 | Holden | 266/120 X |
| 2,626,417 | 1/1953 | Truan | 134/135 X |
| 2,931,745 | 4/1960 | Halgren et al. | 148/28 X |
| 3,277,270 | 10/1966 | Trautman | 266/109 X |
| 3,399,877 | 9/1968 | Birjukova | 266/120 X |
| 3,442,274 | 5/1969 | Keough | 266/120 X |
| 3,642,583 | 2/1972 | Greenberg et al. | 110/8 R X |
| 3,645,802 | 2/1972 | Keough | 148/15 X |
| 3,951,682 | 4/1976 | Schevey et al. | 134/109 X |
| 3,953,248 | 4/1976 | Coch | 148/15 X |
| 3,966,508 | 6/1976 | Mohr | 148/15 |
| 4,011,110 | 5/1977 | Böckenhoff | 148/15 X |

*Primary Examiner*—Roy Lake
*Assistant Examiner*—Paul A. Bell
*Attorney, Agent, or Firm*—John T. Synnestvedt

[57] ABSTRACT

A salt reclamation system especially for use with molten salt baths used for treating articles by immersion of the articles in the bath and then withdrawal thereof, with resultant drag-out of salt. The salt removed from the bath on the surface of the articles is washed from the articles and the salt-laden wash water is returned to the surface of the molten salt bath, with consequent volatilization of the water, which is withdrawn or dissipated as steam, thereby returning the drag-out salt to the bath.

4 Claims, 8 Drawing Figures

SALT RECLAMATION SYSTEM

The invention is concerned with a salt reclamation system particularly adapted for use in association with high temperature molten salt baths or furnaces employed for various purposes in the processing of articles which may be ferrous, metallic but non-ferrous, ceramic, or formed of synthetic polymers. The invention is especially adapted for use in connection with substantially anhydrous high temperature molten salt baths employed in the heat treatment of metallic articles, and the invention is herein described and illustrated in connection with such salt heat treatment baths.

Briefly described the invention contemplates subjecting the heat treated article after emergence from the salt bath, to a water washing, with resultant removal of the salt drag-out from the articles and consequent production of salt-laden wash water or effluent. The salt-laden wash water is returned to the surface of the molten salt bath, and because of the elevated temperature thereof, usually considerably higher than the boiling point of water, the water volatilizes and separates, leaving the returned drag-out salt in the molten bath. The steam is preferably withdrawn and discharged to atmosphere.

It is a general objective of the present invention to provide the simple and effective reclamation system just referred to.

It is an object of the invention to provide a salt reclamation system which completely recovers the drag-out salt and which therefore eliminates sources of pollution, which would be present if the salt-laden wash water were discharged to any normal waste water disposal system.

It is also an object of the invention to recover and reuse the drag-out salt, which would otherwise be wasted, and, in a typical salt treatment bath, this drag-out represents a very substantial quantity, for instance of the order of 100 to 200 pounds per hour.

It is also an objective of the invention to improve the operation and effectiveness of certain forms of molten salt heat treatment baths, for example isothermal quench baths, in the manner more fully explained hereinafter.

How the foregoing objects and advantages are attained, together with others mentioned hereinafter, will appear more fully from the following description referring to the accompanying drawings, in which two embodiments are illustrated.

FIG. 1 is a vertical sectional view through one form of heat treatment bath, with one form of equipment associated therewith for washing drag-out salt from articles treated in the bath and for returning the drag-out salt to the bath; and FIG. 2 to 8 inclusive, illustrate a second embodiment, as applied to a heat treating facility embodying a plurality of treatment baths, the individual figures of this group being as follows:

Figure 1:
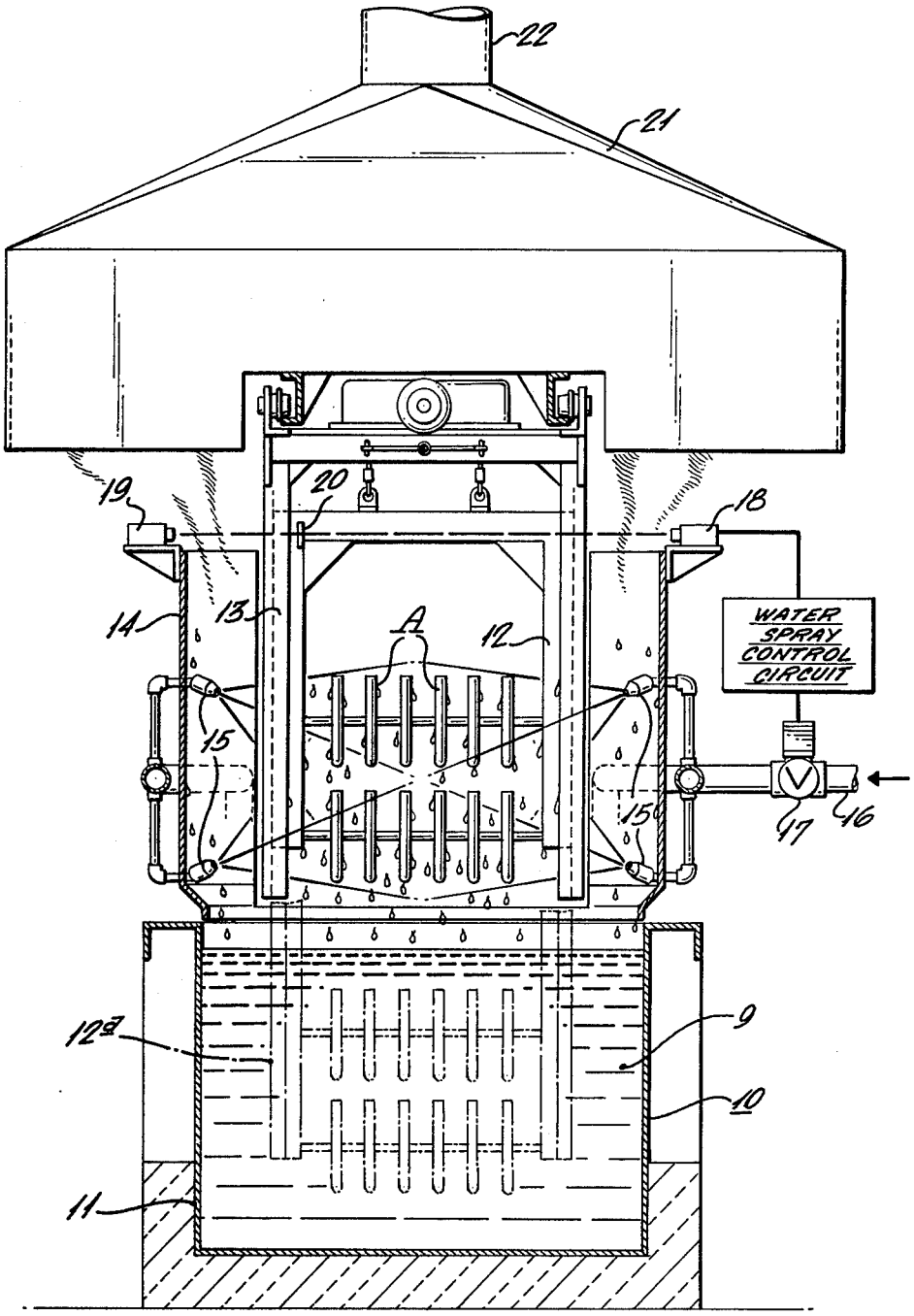

In considering the embodiment illustrated in FIG. 1 it is first noted that the equipment of the invention is there shown associated with a molten salt bath 9 provided in a tank 10 supported by the walls indicated at 11. This bath may be of a variety of heat treatment types, but for purpose of illustration, it is assumed that the bath is a molten salt quench bath operating, for example, at a temperature of the order of 475° F. Such a bath is commonly employed for quenching ferrous metal articles, such as those diagrammatically indicated in FIG. 1 by the letter A. The articles may be supported or carried by any suitable rack or fixture such as indicated at 12, the rack being mounted for vertical movement in any desired manner, for instance by means of tracks or rails 13 arranged above the bath 9 so that the articles may be lowered and thus immersed in the bath and may be raised and thus lifted from the bath. In FIG. 1 the fixture 12 is shown in full lines in a position just above the bath and in dot-dash lines at **12*a*** in the lower position with the articles immersed in the bath. From the full line position the fixture may also be shifted laterally to an unloading station.

Any desired means for raising and lowering the fixture and for laterally moving the fixture from one place to another may be provided, such means not being shown, as they form no part of the invention per se.

In the full line position shown at 12, the fixture supports the articles A in a washing station which may be defined in part by side walls 14 serving to enclose and mount water spray or steam nozzles 15 supplied with water from the main 16 under the control of the valve 17 which, in turn, is desirably operated by a control circuit actuated in any suitable manner according to the vertical motion of the fixture 12. This may be accomplished by a mechanical switch or by a photocell device indicated at 18 responsive to the light beam originating at 19 but which may be intercepted by the beam interrupting element 20 carried by the fixture. Regardless of the specific form of control employed, the invention contemplates that the valve 17 will be opened, thereby resulting in spraying of the articles only at the time when, following heat treatment in the bath 9, the fixture and the articles are lifted out of the bath and reach the position illustrated in full lines at 12. At this time the water sprays are activated and remained in operation for a predetermined period of time. Preferably the water sprays overlap each other so as to effectively spray all of the surfaces of both the articles and the fixture which have been immersed in the bath 9. The fixture is desirably of open-frame construction, in order to permit penetration of the sprays and thereby enhance the washing action. This results in washing of the articles and of the surface of the fixture, with consequent development of droplets or trickles of salt-laden water which descend by gravity to the surface of the bath 9. Because of the high temperature of the bath, the trickles of the spray water volatilize and are dissipated as steam, leaving the drag-out salt in the bath. The steam produced in this manner is advantageously withdrawn through an exhaust or suction hood such as indicated at 21 and the salt freed steam or vapor may then be discharged through the offtake 22. Preferably the hood is positioned or arranged so that an overhead carrier or conveyor may remove the fixture laterally to some appropriate unloading station.

In considering the action of the reclamation system as described above, especially the return of the salt-laden wash water to the surface of the bath, it should be kept in mind that in molten salt baths for various purposes, the bath is substantially anhydrous and, as already mentioned, operates at a temperature considerably higher than the boiling point of water, from about 350° even up to about 1100° F. Such salt baths commonly comprise combinations of salts, for instance 1—sodium and potassium nitrates
2—sodium and potassium nitrites
3—sodium and potassium hydroxide Any of the above may also contain, as contaminants, any one or more of certain other salts, such as sodium, potassium and barium chlorides and carbonates. Various of these contaminants may be introduced either as a result of carry-over on the fixture or on the articles from preceeding salt bath operations, or as a result of reaction of the salts with other compounds when cleaning the surfaces of the articles to be treated.

Although a typical molten salt isothermal quench bath is substantially anhydrous, it is nevertheless capable of absorbing a small quantity of water and it has been found that the absorption of a small quantity of water by such a bath enhances the quenching severity, i.e., the ability of the bath to extract heat from the articles in the quenching operation. The technique of the invention involving the return of trickles of the wash water to the bath is therefore of advantage in assuring the presence or absorption of some water in the quenching bath.

The evaporation of the wash water at the surface of the bath is further of advantage because this aids in dissipating heat from the bath, as is required in order to effect the quenching operation. The volatilization of the water necessarily involves transfer of heat to the water corresponding to the latent heat of evaporation, which aids in increasing the rate of heat dissipation.

In certain prior techniques for salt reclamation salt-laden wash water has been separately treated, as by distillation and brine concentration, for which purpose the salt-laden water is delivered to separate recovery equipment; and in contrast to such prior art techniques, the present invention affords an exceedingly simple and effective reclamation procedure which utilizes the surface of the salt bath itself for the purpose of effecting the separation of the wash water from the salt.

It is of particular advantage in the system of the present invention that the salt-laden wash water is returned to the surface of the salt bath in trickles. This enables maintaining control of the volatilization rate and results in spreading of the action over the surface of the bath, which is important in order to avoid relatively violent, or even explosive action, which might endanger both equipment and personnel, if a large volume of the salt-laden wash water was returned to the surface of the bath in a concentrated area.

The reclamation as described above with relation to the system illustrated in FIG. 1, additionally effects virtually complete recovery of the drag-out salt and virtually eleminates any environmental pollution.

It will be understood that the equipment shown in FIG. 1 and described above may be employed with a single bath or in association with other baths and equipment associated with a production line. An alternative form of equipment conforming with the invention is described herebelow as associated with a production line or facility incorporating a number of treatments or treatment stages, as illustrated in FIGS. 2 to 8 inclusive.

Figure 3:
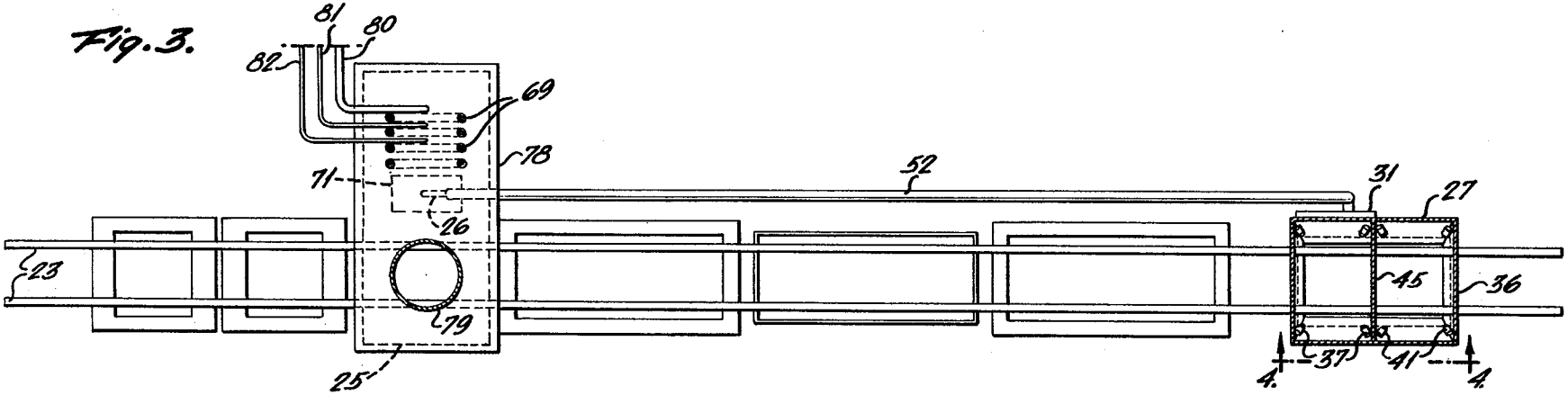
FIG. 3 is an outline plan view of the equipment shown in FIG. 2.
Figure 2:
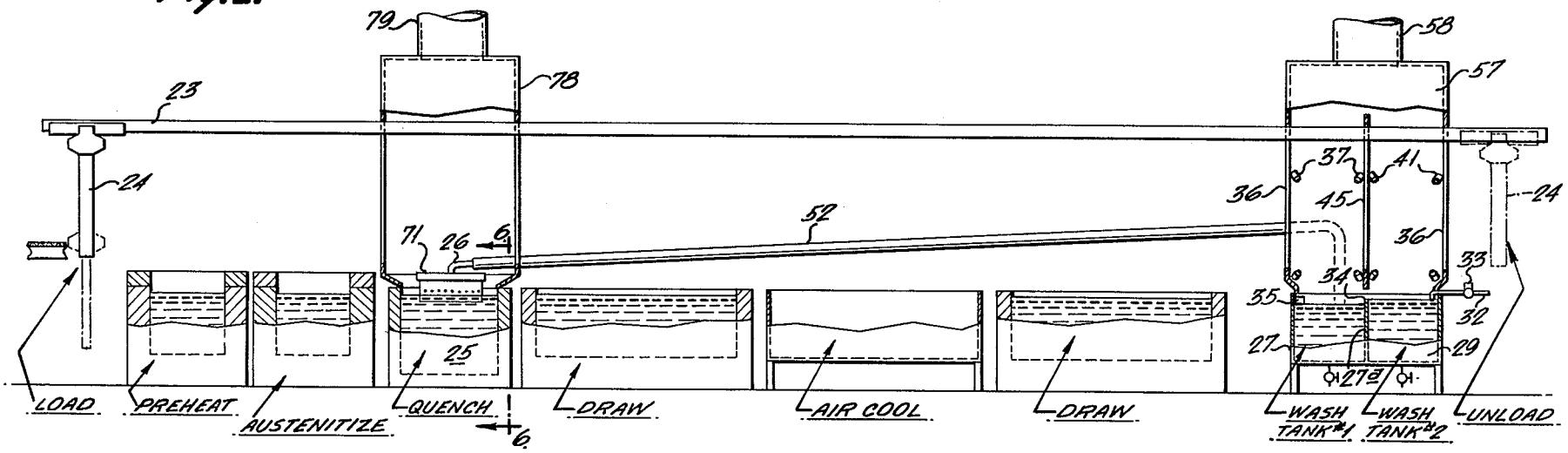
FIG. 2 is a side elevational outline view with certain portions in vertical section, generally illustrating the heat treating facility.

In FIGS. 2 and 3, a heat treating facility or line is illustrated in outline, and the several stages, proceeding from left to right are labelled along the bottom of FIG. 2 as follows; LOAD, PREHEAT, AUSTENITIZE, QUENCH, DRAW, AIR COOL, DRAW, WASH #1, WASH #2, UNLOAD. The plan view of the several stages appears in FIG. 3 above the illustration of the corresponding stages in FIG. 2.

For the purpose of conveying the article supports or fixtures from station to station, a pair of tracks or guide rails 23 are provided in order to support one or more fixtures, such as indicated in outline at 24, this fixture being adapted to carry articles to be treated and being arranged for vertical motion so that the articles may be immersed in and withdrawn from the various baths and treatment facilities of the production line.

Certain of the components illustrated in FIGS. 2 and 3 bear no direct relation to various features of the present invention, and those portions are therefore not described in detail. As a typical adaptation or embodiment of equipment according to the invention, particular reference is made to the molten salt quench bath indicated in general by the numeral 25 in FIGS. 2 and 3 and shown in greater detail in FIGS. 6, 7 and 8. In addition, particular reference is made to the wash tanks #1 and #2 which are indicated in outline in FIGS. 2 and 3, but shown in greater detail in FIGS. 4 and 5.

In the following detail description reference will first be made to the wash tanks, but it is to be kept in mind that articles subjected to the quenching operation in the quench bath 25 are thereafter removed from the quench bath and ultimately reach the region of the wash tanks, in which region the articles are both immersed in the water of the wash tanks and are also sprayed with wash water above the wash tanks. The salt-laden water is ultimately returned to the quench bath through the return line indicated in FIG. 2 at 26.

Figure 5:
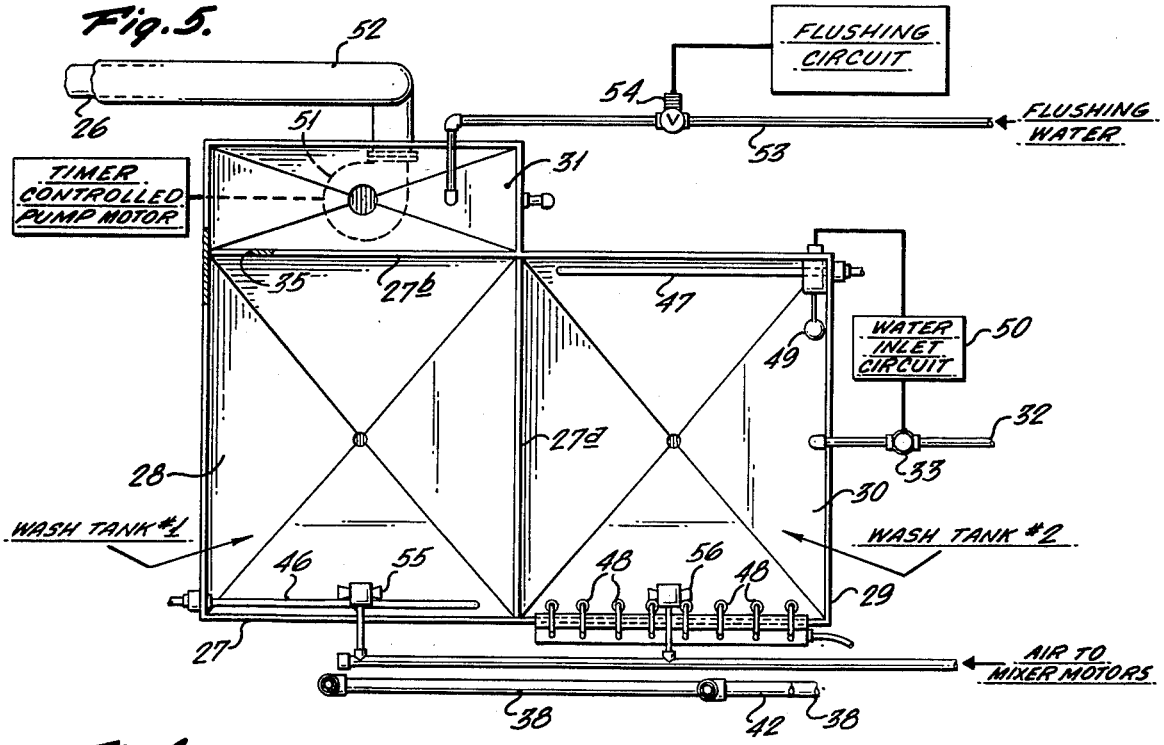
FIG. 5 is a top plan view of the equipment shown in FIG. 4.
Figure 4:
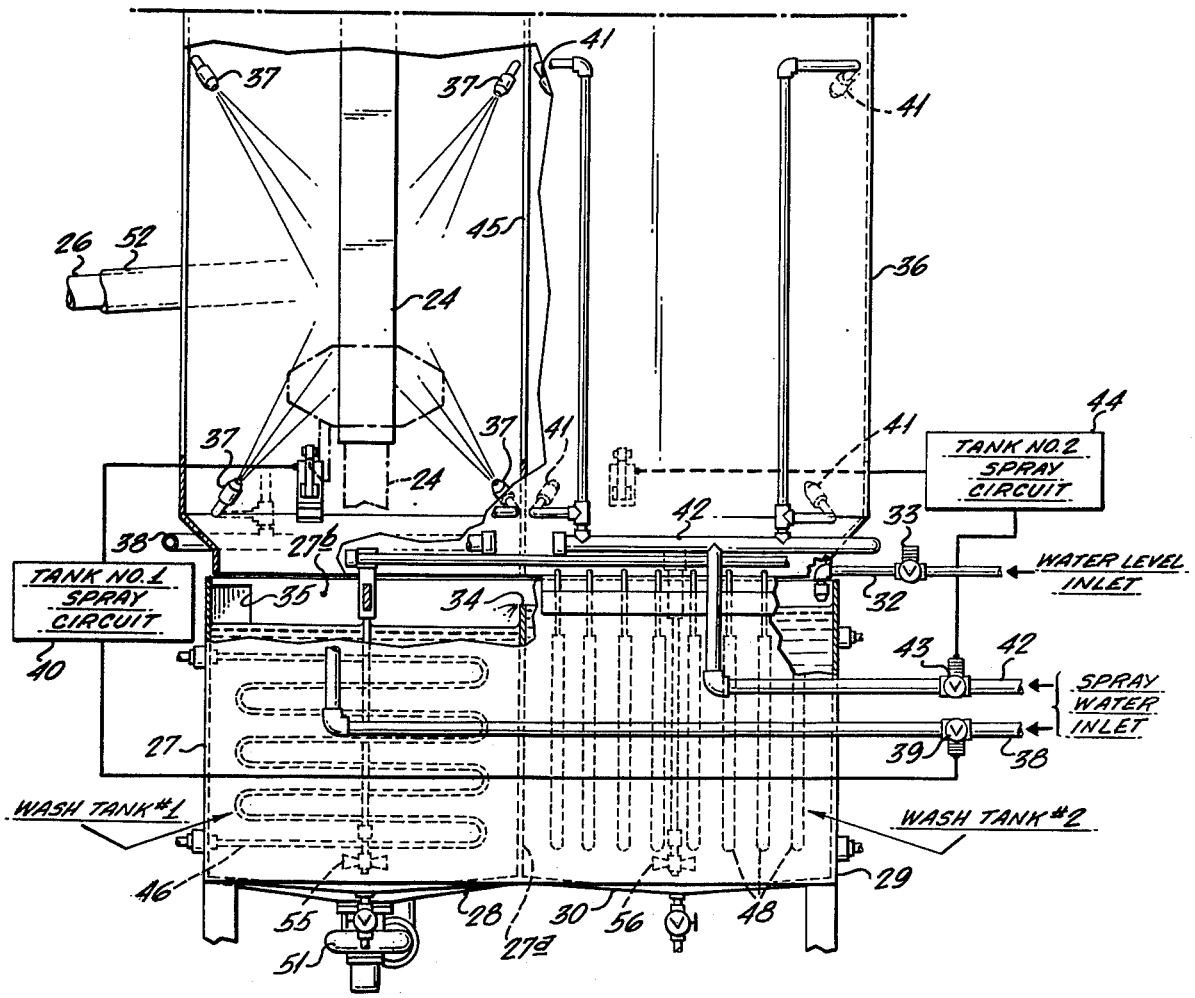
FIG. 4 is an enlarged elevational view, with certain parts in section, illustrating two wash water tanks employed in the facility or system of this embodiment, FIG. 4 being taken in general as indicated by the line 4—4 applied to FIG. 3.

Turning now to the illustration of the wash tanks in FIGS. 4 and 5, it is noted that tank #1 is made up of side walls 27 and has a bottom 28, and tank #2 is formed by side walls 29, being provided with a bottom 30. Tanks 1 and 2 have a common upright wall 27*a*, for a purpose to be mentioned hereinafter.

A sump 31 is provided at one side of tank #1, having a common wall 27*b* with tank #1. Make-up water is delivered to tank #2 through the connection 32 under the control of valve 33, and the upper edge portion 34 of the wall structures between the two tanks terminates at a level so that water from tank #2 overflows into tank #1. Water from tank #1 flows over a weir indicated at 35 into the sump 31.

The region above the two wash water tanks is enclosed in a water spray chamber formed by walls 36. In the enclosed area above the tank #1 spray nozzles 37 are provided, these nozzles being supplied with water from the supply line 38 having a control valve 39 operated by the control circuit indicated at 40 which is arranged in a manner as described above with reference to FIG. 1, to provide for spraying of the articles after they have been lifted out of tank #1 by the fixture 24.

Similarly, spray nozzles 41 are provided in the enclosed zone above wash tank #2, these nozzles being supplied from the line 42 which is controlled by valve 43 having a control circuit 44 of the kind above referred to providing for operation of the nozzles when the articles are lifted out of tank #2 by the fixture 24.

As seen in FIG. 4, the partition or wall 45 between the two spray chambers above the wash tanks is provided with an opening through which the fixture 24 may be passed when the fixture is advanced from the region of tank #1 to the region of tank #2. Certain other walls of the enclosure 36 are also provided with openings so that the fixture may enter and leave the enclosed spray regions above the wash tanks.

Tank #1 is desirably provided with a cooling coil 46, and tank #2 is provided both with a cooling coil 47 and also with an immersion type heating element 48 providing for regulation of the temperature in tank #2. As seen in FIG. 5, the valve 33 of the water supply line 32 for the water introduced into the wash tanks is activated by a float 49 and an associated control circuit 50.

At the bottom of the sump 31 a pump 51 is provided, this pump being adapted to deliver salt-laden wash water from the sump to the return line 26 and thus back to the quench bath 25. The return line 26 is desirably insulated as indicated at 52 in order to minimize heat loss at the time of return of the salt-laden wash water to the quench bath. A sump flushing system is also provided including a water supply line 53 with a control valve 54.

It is contemplated that the supply of water used for the spray nozzles 37 and 41 be passed preliminarily through the coil 46 which is immersed in the water of wash tank #1. This not only serves to conduct heat away from wash tank #1, but also preheats the spray water. In the operation of tank #2, it is advantageous because it aids in maintaining a temperature in tank #2 elevated somewhat above normal water supply temperatures, and in consequence the parts leaving wash tank #2 at a somewhat elevated temperature and therefore dry more rapidly than would the case at a lower temperature.

In operation of the washing equipment just described, a fixture 24 brings the articles to be washed to a position over the wash tank #1 and the articles are then immersed in the water in tank #1. The washing action may be enhanced by employment of a circulating impeller such as indicated at 55. This immersion of the articles in the water of tank #1 will of course transfer heat to the water, and in a typical installation, the water in tank #1 will be maintained at a temperature on the order of 200° to 300° F, preferably about 250° F. Such temperature may be maintained because in operation the water in tank #1 will contain in solution a minimum of about 10–25% salt by weight. An equilibrium temperature will be reached, depending upon the salt concentration established in a given operation. After an interval of washing in the tank, the fixture is lifted to remove the articles from the wash bath into a region just above the bath at which time the control circuit 40 is tripped to activate the spray nozzles 37, thereby washing or rinsing the articles, the sprayed water flowing by gravity from the articles and the fixture into tank #1. The fixture then proceeds to a position over tank #2 and then descends to subject the articles to the washing action of the water in tank #2, this action being enhanced by provision of circulating impeller 56. Following an interval of washing the fixture is again raised and is brought into the region of action of the spray nozzles 41, which are then activated, preferably automatically, by the control circuit 44, so that the articles are washed or rinsed and this water will flow by gravity into tank #2. Finally, the fixture is moved to the unloading station, indicated at the right of FIG. 2.

In a typical installation the water in tank #2 will be maintained at a temperature somewhat below the boiling point, preferably in the neighborhood of 180° F. The common wall **27*a*** between the two wash tanks results in heat transfer from tank #1 to tank #2, and thus aids in providing the desired temperature in tank #2.

In consequence of the washings and sprayings, the fixture and the articles emmerge from the equipment with only a minor trace of salt remaining on the surfaces, usually less than 2% by weight.

As some substantial quantity of vapor or steam may be released from the washing baths and rinsing sprays, it is contemplated that an exhaust hood 57 (see FIG. 2) be arranged above the spray tanks, the hood being provided with an offtake 58.

With the washing tank equipment arranged as above described, the water from tank #2 overflows from that tank into tank #1, and the water in tank #1 overflows from that tank into the sump 31. At timed intervals the motor for pump 51 is operated in order to deliver salt-laden water from the sump 31 through the connection 26 back to the quench bath to be described herebelow. In addition, when desired, the sump 31 is flushed with water by opening the flushing control valve 54, and this water is also delivered by the pump 51 through the connection 26 to the quench tank. The action which takes place in the quench bath upon delivery of the salt-laden water through the connection 26 will be described hereinafter following the description of the structure and arrangement of the quench tank.

Figure 7:
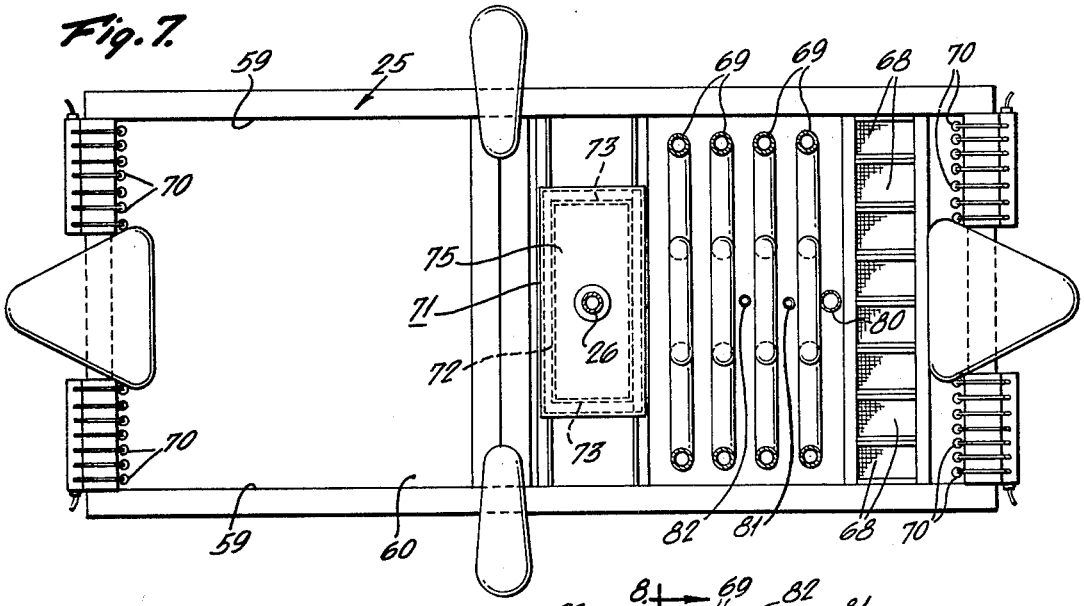
FIG. 7 is a plan view of the equipment shown in FIG. 6.
Figure 6:
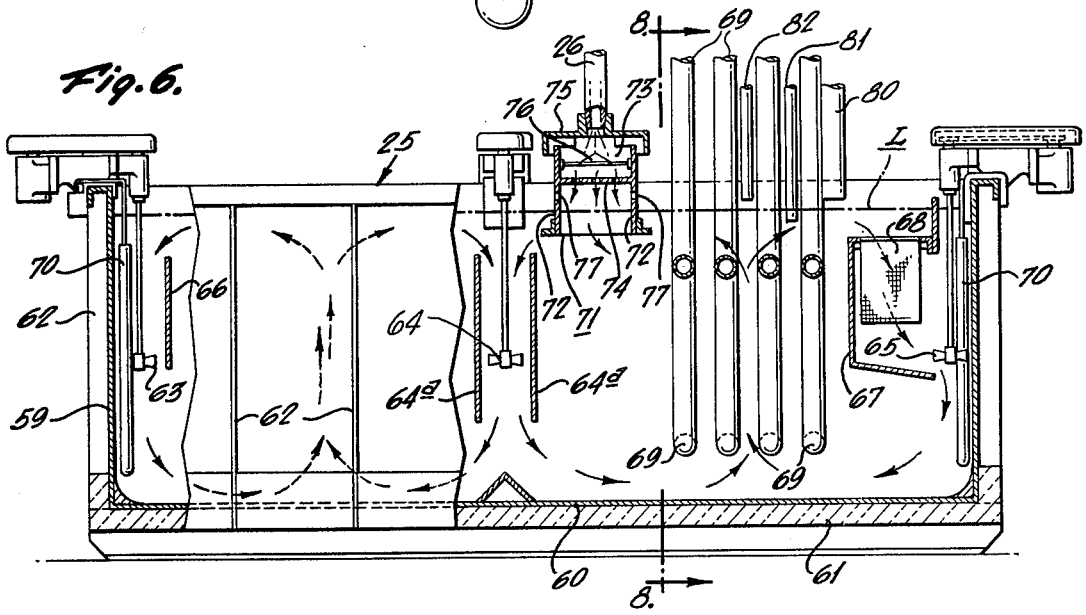
FIG. 6 is a vertical sectional view, with certain parts shown in elevation, of a quenching bath employed in the system of FIGS. 2 to 8, FIG. 6 being taken generally as indicated by the section line 6—6 applied to FIG. 2.
Figure 8:
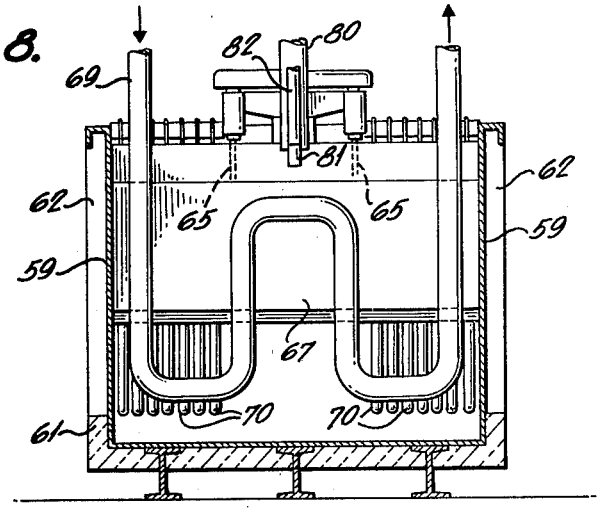
FIG. 8 is a vertical sectional view taken as indicated by the section line 8—8 applied to FIG. 6.

From FIGS. 3, 6 and 7 it will be seen that the quench tank 25 is elongated transversely of the production line. The tank is made up of steel plate walls 59 and a bottom 60, with a ceramic foundation layer 61 below the bottom wall. The upright walls 59 are desirably provided with fins 62 which serve both for strengthing the side walls and also for increasing heat transfer to the surrounding air.

Circulation of the molten salt in the quench bath is provided by employment of impellers such as indicated at 63, 64 and 65. Two laterally spaced impellers 63 operate in the channel formed behind the baffle 66 and these impellers are arranged to establish a downwardly moving current in the bath at the left hand end thereof, as viewed in FIG. 6. Two impellers 64 in the mid region of the bath are located between baffle walls **64*a*** near the side walls and are operated to induce a downwardly moving current, so that there is a general circulation in the left hand portion of the quench bath in the manner indicated by the arrows.

Similarly, the impellers 64 in the mid region, and the two spaced impellers 65, which are positioned near the right hand end of the bath as viewed in FIG. 6, cause circulation as indicated by the arrows. The downward current near the right hand end occurs behind the baffle 67 having filter baskets 68 associated therewith (see both FIGS. 6 and 7), for a purpose to be explained hereinafter.

Cooling tubes or coils 69 are provided in the quench bath in order to dissipate heat. Advantageously these tubes are radiant tubes carrying water mist entrained in an air stream which is forced or circulated through each tube. By this means, extensive heat transfer from the bath can be effected, as is required during the quenching operation.

Immersion type electrical heating elements 70 are preferably also provided in each end of the bath in order to assist in controlling the bath temperature. For example, during intervals when quenching is not occurring, it may be desired to terminate the flow through the cooling coils 69 and activate immersion heaters 70 in order to maintain the bath at the desired quenching temperature. When quenching is resumed, the immersion heaters would of course be deactivated and the circulation through the cooling tubes re-established.

In the central upper portion of the quenching bath a trough structure generally indicated at 71 is provided. This structure includes side plates 72 spaced from each other and lying in vertical planes positioned transversely of the bath. End walls 73 are joined to the ends of the side plates 72 to form a box like structure which is open at both the bottom and the top, the lower edge of the box walls being positioned so that they lie below the surface of the salt bath which latter is located at L in FIG. 6.

A horizontal perforated plate or deck 74 is provided within the trough structure 71 at an elevation above the level of the salt bath, so that salt-laden water introduced above the perforated deck 74 will trickle through the perforations and descend in subdivided form to the surface of the bath. A roof or hood 75 overlies the upper edges of the trough structure in spaced relation, as clearly appears in FIG. 6, and the return line 26 for the salt-laden wash water delivers the wash water through an opening in the cover 75. Perferably a spreading deflector 76 is provided in the path of the returning wash water so as to distribute the water over the upper surface of the perforated deck 74.

The upright side walls 72 of the trough are provided with apertures 77 below the deck 74 but above the level of the salt bath, to provide for free release of the steam developed by evaporation of the wash water as it trickles onto the surface of the bath. The space between the overlying hood 75 and the upper edges of the walls of the trough also provides for free escape of steam. In the event of clogging of the perforations in the deck 74, the wash water may overflow over the upper edges of the trough walls.

As seen in FIGS. 2 and 3, in order to withdraw and discharge the steam generated, an exhaust hood 78 having an offtake 79 is provided over the quench bath, the side walls of this hood also having openings to permit entrance and exit of the fixtures carrying the articles being treated.

Make-up salt may be supplied to the bath through the connection indicated at 80. Advantageously, the make-up salt is introduced by a control system adapted to maintain a level substantially as indicated at L in FIG. 6. Any suitable control system may be employed for this purpose, for instance the use of pneumatic tubes such as shown at 81 and 82 having their lower open ends at slightly different elevations. These tubes may be used to monitor back pressure and thereby operate pneumatic switches which in turn control the supply of salt delivery through the supply connection 80.

As explained above in connection with the embodiment illustrated in FIG. 1, the circulation system of the salt-laden wash water causes the salt-laden water to be delivered to the surface of the quench bath in the form of drops or trickles. In the embodiment of FIGS. 2 to 8, the construction of the trough 71 aids in assuring subdivision of the water delivered to the surface of the bath and effects in distribution of the salt-laden water over some appreciable area of the surface of the bath. This avoids tendency toward violent flashing into steam of a large quantity of wash water concentrated on a small area of the bath surface.

In connection with the action of the quench bath it is also pointed out that the circulation impellers 63, 64 and 65 are of importance, not only in preventing temperature stratification and in assuring circulation of the molten salt over the surfaces of the cooling tubes 69 and of the finned side walls of the tank to thereby enhance heat transfer. In addition this circulation is also of importance in relation to the salt-laden wash water which is delivered to the quench bath. As above pointed out, the molten salt of the quench bath will absorb a small quantity of water and this is beneficial in the quench bath because the presence of the water enhances the quenching severity. Circulation of the molten salt will aid in distributing the absorbed water to all parts of the bath and thereby distribute the effect of the absorbed water.

As seen in FIGS. 2 and 3, the salt reclamation system is shown as applied to a treatment line incorporating several treatment stages between the quenching bath and the water washing tanks. Thus, FIGS. 2 and 3 illustrate two draw baths and an air cooling zone located between the quench bath and the wash tanks. It is intended that the draw baths also comprise molten salt, advantageously salts of the type referred to above in the description of the embodiment of FIG. 1, for instance sodium and potassium nitrates or nitrites.

In a typical installation, the two draw baths may be maintained at different temperatures and used alternatively. The first draw bath (immediately following the quench bath) may be maintained at a temperature of 700° to 750° F., and the second draw bath (immediately preceeding the wash tanks) may be maintained at a temperature of the order of 600° F).

Since it is contemplated that the quench bath and the two draw bath are desirably formed of the same salt or salts, the reclamation system providing for return of the salt-laden wash water from the wash tanks to the quench bath will maintain a balanced condition, with respect to the salt in any intervening draw bath. Thus, in operation salt will be carried on the surface of the articles from the quench bath to a draw bath, and a corresponding amount of salt will be transferred on the surface of the articles from the draw bath into the wash tanks, and the return of the salt-laden water from the washing system back to the quench bath will approximately replace the drag-out from the quench bath.

Either of the embodiments illustrated in FIG. 1 and in FIGS. 2 to 8 may be employed in association with any desired system for preheating or heating articles to be subjected to the quenching operation. This may be done in a furnace or, alternatively, in salt baths adapted to raise the temperature of the articles to be quenched to the desired temperature above the quenching temperature.

In FIGS. 2 and 3 two salt baths are illustrated in the treatment line upstream of the quenching bath. One of these is identified as a bath provided to preheat the articles and the other is identified as a bath to austenitize the articles. Such heating baths may typically be maintained, respectively, at 1400° and 1575° F., although it will be understood that these temperatures may be at different levels, depending upon the character of the treatment, the nature of the articles, etc.

Where the heating prior to quenching is effected by means of salt baths, as is contemplated in the embodiment of FIGS. 2 to 8, because of the higher temperature utilized for such heating, the salt bath preferably comprises salts other than those ordinarily usable in the quench bath. It is contemplated that in the heating baths sodium and potassium chlorides, for example in a mixture of about 50% of each, may be used, these chlorides having appropriate melting and vaporization temperatures permitting the maintenance of preheat and austenitize temperatures in the range from about 1100° to 1600° F. The temperatures usable in the heating baths and the character of the salts employed in those baths, are such that it is not desirable to recirculate the wash water upstream to the heating baths, because of the violent flash or explosion type of reaction which would follow.

Because of this, the immersion of the articles in the heating baths, and the transfer of the articles from those baths to and into the quench bath results in drag-out of salt from the heating baths into the quench bath. The invention further makes provision for the withdrawal of the chloride salts from the molten quench bath. This being accomplished as described just below.

When the drag-out sodium and potassium chlorides are transferred into the quench bath, they go into solution in the salt of the quench bath and, after a period of operation reach the saturation point at the quenching bath temperature. The excess beyond the saturation content forms crystals, and these crystals are carried in suspension in the circulating flow of the quench bath, ultimately passing into the filter baskets 68 which are desirably formed of wire screening of sufficiently fine mesh to strain out the crystals. The filter baskets also accummulate scale which separates from the surfaces of the articles being treated, and periodically the filter baskets are removed and cleaned and then returned to the position indicated in the circulation system.

The arrangement of the quench bath, therefore, provides not only for the reclamation of the salts of the quench bath and dissipation of the wash water, but concurrently provides for separation of chloride salt crystals, as well as scale from the quenching bath.

From the foregoing it will be seen that the system provided by the present invention, affords numerous important advantages in a heat treatment facility, including the following:

Complete recovery of salts entering the wash water, and very high percentage recovery of the salt drag-out on the surfaces of the articles and the fixtures.

The evaporation of water from the surface of an isothermal quench bath aids in dissipating heat. In addition the absorption of some water by the molten quench bath and the circulation thereof throughout the mass of the bath enhances the quenching severity because the water present extracts more heat when it evaporates, the additional heat extracted corresponding to the latent heat of evaporation.

In the heat treatment of articles, including utilization of one or the other of the draw baths, the thermal and transformational shock are reduced when the articles are transferred to the washing zone, and this is true whether the transfer occurs directly from a 600° F. draw bath, or from a draw bath at 750° F. followed by an air cooling step. The employment of two sequential wash tanks, the first of which has a temperature of the order of 250° F. and the second a temperature appreciably below the boiling point of water, is of importance in this reduction of shock, since applicants arrangement does not require that the articles be transferred directly from a draw bath into a wash tank at or close to the temperature ordinarily encountered in normal water supplies. This employment of wash water at a somewhat elevated temperature is advantageous not only following a sequence of treatments including a quench bath and a draw bath, but also in other sequences, where a wash water bath follows any preceeding treatment employed to change the crystal or other characteristics of the metal being treated.

The provision of a common wall interface between the first and second wash tanks also makes use of some heat which would otherwise be wasted, heat being transferred through this common wall from the first to the second wash waters.

The overall system, including the delivery of the water sprays into the wash water tanks, and the overflow from the second tank into the first, and from the first to the sump, and the delivery of the salt-laden water back to the quenching bath reduces overall water comsumption as compared with various prior art systems.

I claim:

1. A facility for heat treatment of articles comprising a sequence of molten salt baths including a quenching bath and a draw bath downstream of the quenching bath, means for immersing the articles sequentially in said baths, and means for water washing drag-out salt from the articles after removal from the draw bath, the washing means comprising at least two water washing stages, the first of which is maintained at a salt concentration providing for maintenance of a temperature on the order of about 200° to 300° F.

2. A facility for heat treatment of articles comprising a sequence of molten salt baths including a quenching bath and a draw bath downstream of the quenching bath, means for immersing the articles sequentially in said baths, and means for water washing drag-out salt from the articles after removal from the draw bath, the washing means including a water washing bath and a water spray, and means for preheating the spray water by heat exchange with the water of the washing bath.

3. Apparatus for use in heat treating articles, comprising a substantially anhydrous molten salt bath having an upwardly exposed top surface, means for immersing articles to be heat treated through said surface into the bath and for withdrawing the treated articles through said surface, with consequent drag-out of salt with the articles, mechanism for water washing the articles withdrawn from the molten salt bath comprising first and second wash water tanks, means for introducing the articles sequentially into the first and second tanks, said tanks having common wall structure therebetween for transfer of heat from one tank to the other, means for delivering water from the second tank to the first, and means for delivering water from the first tank to the surface of the molten salt bath, including means for subdividing the wash water and for delivering the subdivided wash water to the surface of the molten bath.

4. Apparatus for use in heat treating articles, comprising a substantially anhydrous molten salt bath having an upwardly exposed top surface, means for immersing articles to be heat treated through said surface into the bath and for withdrawing the treated articles through said surface, with consequent drag-out of salt with the articles, and mechanism for water washing the articles withdrawn from the molten salt bath comprising first and second wash water tanks, and means for introducing the articles sequentially into the first and second tanks, said tanks having common wall structure therebetween for transfer of heat from one tank to the other.

* * * * *